US011375870B2

(12) United States Patent
Hahn et al.

(10) Patent No.: US 11,375,870 B2
(45) **Date of Patent: *Jul. 5, 2022**

(54) WET CLEANING DEVICE HAVING A CLEANING ROLLER WHICH CAN BE ROTATED ABOUT A ROLLER AXIS

(71) Applicant: Vorwerk & Co. Interholding GmbH, Wuppertal (DE)

(72) Inventors: Pia Hahn, Schwelm (DE); Michael Blum, Wuppertal (DE); Jochen Jentsch, Berlin (DE); Sabine Schweppe, Monheim (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 844 days.

This patent is subject to a terminal disclaimer.

(21) Appl. No.: 16/313,498

(22) PCT Filed: Jun. 13, 2017

(86) PCT No.: PCT/EP2017/064357
§ 371 (c)(1),
(2) Date: Dec. 27, 2018

(87) PCT Pub. No.: WO2018/001715
PCT Pub. Date: Jan. 4, 2018

(65) Prior Publication Data

US 2020/0305675 A1 Oct. 1, 2020

(30) Foreign Application Priority Data

Jun. 28, 2016 (DE) ..... 10 2016 111 810.9

(51) Int. Cl.
*A47L 13/22* (2006.01)
*A47L 11/40* (2006.01)
(Continued)

(52) U.S. Cl.
CPC ..... *A47L 13/22* (2013.01); *A47L 11/4041* (2013.01); *A47L 11/185* (2013.01); *A47L 11/19* (2013.01);
(Continued)

(58) Field of Classification Search
CPC ..... A47L 11/4013; A47L 11/4016; A47L 11/4041; A47L 11/33
See application file for complete search history.

(56) References Cited

U.S. PATENT DOCUMENTS 1,536,687 A 5/1925 Oatey
4,875,246 A * 10/1989 MacGregor ..... A47L 11/185 15/98
(Continued)

FOREIGN PATENT DOCUMENTS

DE 102 29 611 B3 1/2004
DE 20 2009 013 434 U1 12/2009
(Continued)

OTHER PUBLICATIONS

International Search Report of PCT/EP2017/064359, dated Sep. 5, 2017.
(Continued)

*Primary Examiner* — Monica S Carter
*Assistant Examiner* — Sarah Akyaa Fordjour
(74) *Attorney, Agent, or Firm* — Collard & Roe, P.C.

(57) ABSTRACT

A wet cleaning device, in particular a wet wiping device, has a cleaning roller which is rotatable about a roller axis and has a cleaning lining. In order to create a wet cleaning device in which the regeneration effect is optimized, in particular while using a minimum of liquid, the wet cleaning device has a decelerating element to assist the removal of liquid and/or of dirt from the cleaning roller, which element has an impact edge directed radially outwards with respect to the
(Continued)

roller axis and is arranged between fibers of the cleaning lining during a regeneration operation in such a way that the free ends of the mechanically unloaded fibers project outwards in the radial direction beyond the impact edge.

14 Claims, 3 Drawing Sheets

(51) Int. Cl.
*A47L 11/18* (2006.01)
*A47L 11/19* (2006.01)

(52) U.S. Cl.
CPC ..... *A47L 11/4083* (2013.01); *A47L 2201/00* (2013.01)

(56) References Cited

U.S. PATENT DOCUMENTS 5,657,504 A 8/1997 Khoury
8,601,643 B2 * 12/2013 Eriksson ..... A47L 9/0477 15/383
9,289,105 B2 3/2016 Moes
2007/0011838 A1 1/2007 Davis et al.
2017/0119225 A1 * 5/2017 Xia ..... A47L 5/28

FOREIGN PATENT DOCUMENTS

DE 10 2014 119 188 A1 6/2016
EP 0 898 924 A1 3/1999
EP 2991533 B1 * 6/2017 ..... A47L 9/2847

OTHER PUBLICATIONS

International Search Report of PCT/EP2017/064748, dated Sep. 22, 2017.
International Search Report of PCT/EP2017/064357, dated Oct. 16, 2017.
International Search Report of PCT/EP2017/064365, dated Sep. 20, 2017.
International Search Report of PCT/EP2017/064745, dated Sep. 20, 2017.

* cited by examiner 12
11
1
9
13
10
2
3
b

WET CLEANING DEVICE HAVING A CLEANING ROLLER WHICH CAN BE ROTATED ABOUT A ROLLER AXIS

CROSS REFERENCE TO RELATED APPLICATIONS

This application is the National Stage of PCT/EP2017/064357 filed on Jun. 13, 2017, which claims priority under 35 U.S.C. § 119 of German Application No. 10 2016 111 810.9 filed on Jun. 28, 2016, the disclosures of which are incorporated by reference. The international application under PCT article 21 (2) was not published in English.

FIELD OF TECHNOLOGY

The invention relates to a wet-cleaning device, in particular to a wet wiping device, having a cleaning roller that can rotate around a roller axis, and has a cleaning lining with fibers having free ends.

The invention further relates to a method for operating a wet-cleaning device, in particular a wet wiping device, wherein liquid and/or dirt is removed from a cleaning roller of a wet-cleaning device that rotates around a roller axis during a regeneration operation.

PRIOR ART

Wet-cleaning devices or methods for operating a wet-cleaning device are known in prior art.

For example, DE 102 29 611 B3 discloses a wet-cleaning device with a wiping body that can be rotatably driven around rotational axis, in which a cleaning liquid is removed from a supply tank and sprayed onto the surface of the wiping body by means of spray nozzles arranged in the direction of the rotational axis of the wiping body. The wiping body moistened in this way is guided over a surface to be cleaned during a wiping operation, wherein the wiping body picks up dirt from the surface to be cleaned.

During the wiping operation, the wiping body is increasingly loaded with dirt to such an extent that necessitates a regeneration of the wiping body. To this end, the wiping body is lifted from the surface to be cleaned, encased by a housing and sprayed with unused cleaning liquid. The wiping body rotates, so that the cleaning liquid and/or dirt can be driven out of the wiping body, hit the interior side of the housing and be transferred into a receiving tank.

The disadvantage here is that a large quantity of cleaning liquid is required during the regeneration operation to moisten or rinse the wiping body, so that the centrifugal forces arising during the rotation of the wiping body can spin off the dirt that accumulated on the wiping body.

SUMMARY OF THE INVENTION

Proceeding from the aforementioned prior art, the object of the invention is to create a wet-cleaning device which enables a regeneration of the cleaning roller with the best possible result, and in particular with as little use of liquid and a short regeneration time.

Initially proposed for achieving the aforementioned object is a wet-cleaning device, which has a decelerating element to support the removal of liquid and/or dirt from the cleaning roller, wherein the decelerating element has an impact edge relative to the roller axis of the cleaning roller that during a regeneration operation is arranged so as to radially cover the fibers of the cleaning lining to such an extent that the free ends of the mechanically unloaded fibers outwardly protrude over the impact edge in a radial direction.

According to the invention, the cleaning lining of the cleaning roller is now no longer regenerated exclusively by spinning liquid and/or dirt from the fibers of the cleaning lining that radially protrude during the rotation of the cleaning roller. Instead, the cleaning roller, in particular the fibers of the cleaning lining, now have allocated to them a decelerating element, which is designed to decelerate the fibers of the roller lining that rotates around the roller axis, so that the latter are abruptly decelerated by the decelerating element and are bent over the impact edge of the decelerating element. The inertia of the abruptly decelerated fibers produces a whip effect, in which liquid and dirt adhering between the fibers of the cleaning lining are torn out. The new rotation center on the decelerating element here allows the free ends of the fibers bent over the impact edge of the decelerating element to reach accelerations that exceed seven times the acceleration achieved due solely to the rotation around the roller axis.

In relation to a radial direction proceeding from the roller axis, the decelerating element here advantageously has the kind of expansion that yields a distance between the decelerating element and the roots of the fibers on the one hand, and a distance between the free ends of the fibers extending in a radial direction and the decelerating element on the other. As a result, the free ends of the fibers have the leeway to bend over the impact edge given an impact on the impact edge of the decelerating element on the one hand, and on the other to be pulled off of the impact edge in the direction opposite the bending as the cleaning roller continuous to rotate, and be guided through between the cleaning roller and decelerating element.

It is proposed that the decelerating element be mounted on the wet-cleaning device so as to be displaceable relative to the cleaning roller. The decelerating element is usually only needed during the regeneration operation of the cleaning roller. Therefore, it is recommended that the decelerating element be removed from the cleaning lining of the cleaning roller before performing a wiping operation, i.e., that it be displaced away from the cleaning roller. To this end, the decelerating element is advantageously displaceably arranged on the wet-cleaning device, for example so that the latter can be swiveled toward the cleaning roller and swiveled away from the cleaning roller. A corresponding swiveling arm can be provided for this purpose. Alternatively, it is of course also possible to displace the decelerating element relative to the cleaning roller in some other way, for example by linearly shifting the decelerating element or the like.

It is proposed that the decelerating element be immovably arranged on the wet-cleaning device during the regeneration operation. As a consequence, the decelerating element is fixed in place relative to the wet-cleaning device, while the fibers of the cleaning lining are moved against the decelerating element by the rotation of the cleaning roller. Alternatively, however, it can also be provided that the decelerating element be moved in a direction opposite the rotational direction during the regeneration operation. As a result, the speed at which the fibers of the cleaning lining impact the decelerating element can be increased further.

It is especially recommended that the decelerating element be essentially rod-shaped in design, in particular that it be a wire. Rod-shaped here refers to the shape of an object that has a very large length relative to its width or diameter. The cross section of the rod shape can here be round, angular, square, oval, polygonal or the like. For example, an inventively very advantageous decelerating element is a wire, which has a very large length relative to its diameter. As a result of the rod shape, the free ends of the fibers of the cleaning lining can be bent around the impact edge of the decelerating element on the one hand, and as the cleaning roller continues to rotate can be pulled away from the impact edge and guided between the decelerating element and cleaning roller on the other. It is here especially recommended that the decelerating element have a convexly curved upper surface at least in the area of the impact edge, so that the fibers can be guided as gently as possible around the decelerating element or impact element, so as to thereby not least also increase the service life of the cleaning lining.

It is proposed that the decelerating element have a height of 0.3 to 5 mm, preferably a height of 0.5 mm to 2 mm, in relation to a radial direction relative to the roller axis, and/or be arranged parallel to the roller axis along the entire length of the cleaning lining. In conjunction with the length parallel to the roller axis, the height of the decelerating element prescribes the contact surface in which the fibers impact the decelerating element, meaning the surface opposite the rotating fibers. According to the invention, the height of the decelerating element is less than the length of the mechanically unloaded fibers, so that the free ends of the fibers protrude over the decelerating element, i.e., protrude over the impact edge, and can bend. In relation to a decelerating element designed as a wire, the height of the decelerating element is equal to the diameter of the wire, regardless of the distance between the decelerating element, i.e., the wire, and the roots of the fibers in the cleaning lining.

In particular, it is recommended that the height of the decelerating element correspond to roughly one fourth to one half the length of the fibers. For example, if the fibers have a free length of 5 mm, the height of the decelerating element should thus preferably measure roughly between 1 mm and 2.5 mm. In the case of a decelerating element designed as a wire, this would then be the diameter. The distance between the decelerating element and roots of the fibers should correspond to at least the diameter of the fibers, so that the fibers can be pulled through under the decelerating element. With regard to the length of the decelerating element parallel to the longitudinal extension of the roller axis, it is recommended that the decelerating element be formed over the entire length of the cleaning lining of the cleaning roller, so that the entire circumferential surface of the cleaning lining can be regenerated. It could potentially make sense to vary the distance between the decelerating element and cleaning lining along the longitudinal extension of the cleaning roller, for example to create a larger or smaller distance that ensures a stronger or weaker regeneration effect in individual longitudinal sections of the cleaning lining. For example, consideration can here be given to an expected distribution of dirt and/or moisture along the longitudinal extension of the cleaning lining.

In addition, it is proposed that the impact edge of the decelerating element be arranged roughly in the area of one fourth to one half the fiber length of the fibers relative to the mechanically unloaded fibers facing in the radial direction. In this advantageous embodiment, the fibers can be bent over the impact edge at half their height, so that at least half of their length is accelerated around the new rotational midpoint, and adhering liquid and/or dirt is optimally spun off. For example, in relation to 5 mm long fibers, the impact plate, in particular the side of the impact plate facing radially outward, is located at a length of 1.25 mm to 2.5 mm, calculated form the location of the fiber roots, e.g., which are anchored in a basic matrix of the cleaning lining.

The cleaning lining is advantageously a textile lining, in particular one in which the fibers can be made to stand radially outward through exposure to a centrifugal force. Suitable in particular is a microfiber textile lining, whose individual fibers are fine enough to ensure a special flexibility of the fibers, making it especially easy for the fibers to bend over the impact edge.

It is also proposed that the cleaning roller have a roller diameter of 40 mm to 50 mm, in particular of roughly 45 mm. For example, a cleaning roller with such a roller diameter can be used not just exclusively in hand-operated wet-cleaning devices, but advantageously also in cleaning robots, which are intended to have the smallest or lightest design possible, and use the least possible water volume for cleaning purposes.

Within the meaning of the invention, basically all devices capable of performing a wet cleaning operation, whether exclusively or among other tasks, are to be understood as wet-cleaning devices. On the one hand, these encompass the hand-operated and independently traversable wet-cleaning devices, including in particular wet-cleaning robots. However, combined dry and wet-cleaning devices are also wet-cleaning devices within the meaning of the invention. Apart from conventional floor cleaning devices for a floor, wet-cleaning devices for cleaning above-floor surfaces are also intended, to also include wet-cleaning devices for cleaning window surfaces, for example.

Also proposed in addition to the wet-cleaning device according to the invention is a method for operating a wet-cleaning device, in particular a wet-wiping device, in which liquid and/or dirt are removed from a cleaning roller of the wet-cleaning device rotating around a roller axis during a regeneration operation, wherein a decelerating element for the regeneration operation is arranged so as to radially cover fibers of a cleaning lining of the cleaning roller to a point where an impact edge of the decelerating element protrudes so far between the fibers that the free ends of the fibers are folded over the impact edge during the rotation of the cleaning roller.

As already described in reference to the wet-cleaning device according to the invention, the decelerating element is displaced between the fibers of the cleaning lining in such a way that a free end area of the fibers can bend over the impact edge of the decelerating element. The impact on the decelerating element abruptly decelerates the fibers, and the ensuing whip effect causes them to lose contaminants adhering to the free fiber ends. By comparison to prior art, this as a whole [results in] a better cleaning effect given an identical liquid quantity or requires a smaller quantity of liquid given the same good cleaning result for the regeneration process, which is advantageous in particular with respect to automatically traversable wet-cleaning devices not intended to carry a large water tank. In addition, it is also possible to reduce the speed of the cleaning roller and achieve the same cleaning effect.

In particular, it is proposed that the cleaning roller be rotated during the regeneration operation at a speed of 1500 RPM to 6000 RPM, in particular at a speed of 4000 RPM to 5000 RPM. Given a cleaning roller with a roller diameter of 45 mm, for example, prior art requires speeds of up to 10000 RPM to achieve an optimal cleaning result. The method according to the invention and configuration of the wet-cleaning device according to the invention now make it possible to significantly reduce the speed, specifically to speeds of at most 6000 RPM.

BRIEF DESCRIPTION OF THE DRAWINGS

The invention will be explained in greater detail below based on exemplary embodiments. Shown on.

DESCRIPTION OF EMBODIMENTS

Figure 1:
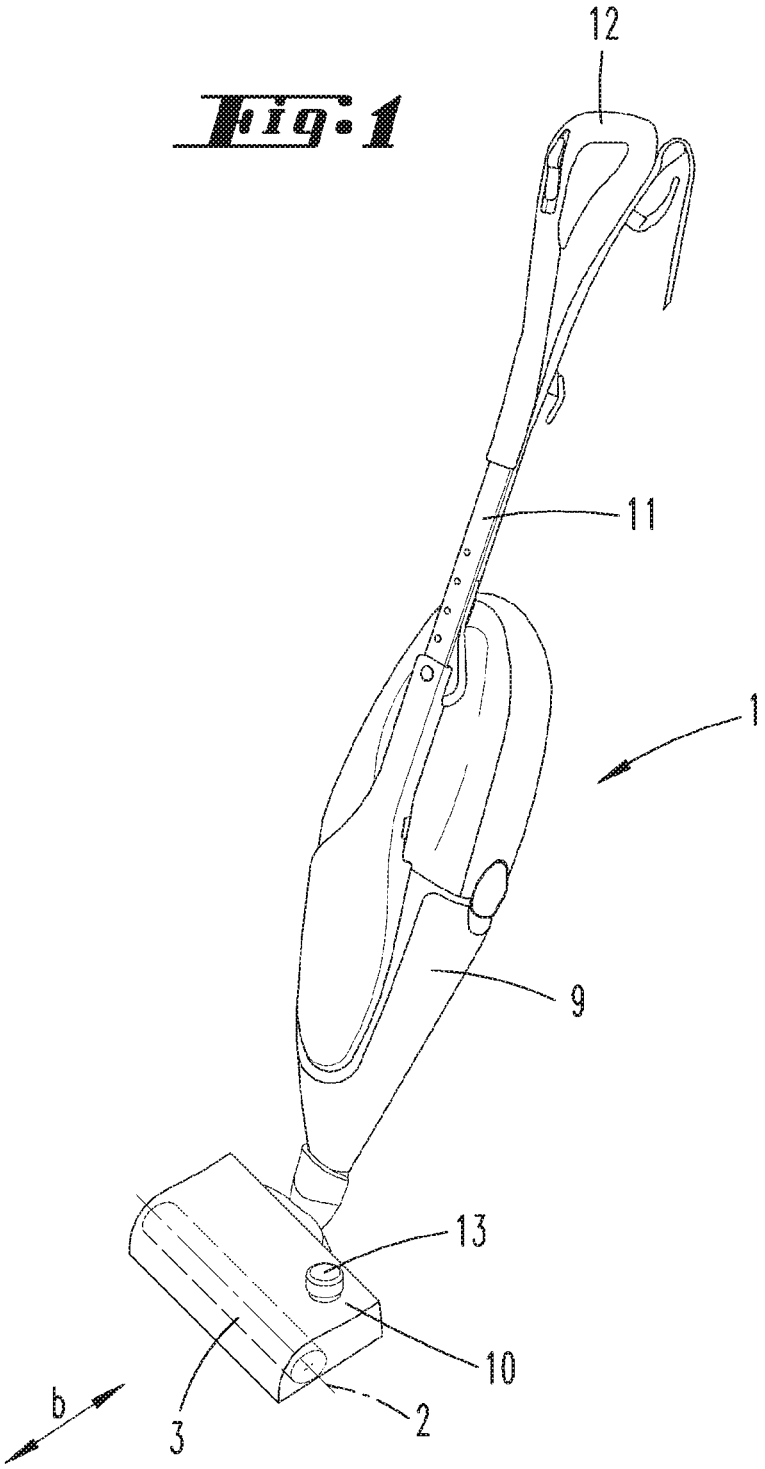
FIG. 1 is a wet-cleaning device according to the invention.

FIG. 1 shows a wet-cleaning device 1, which is here designed as a hand-operated wet-cleaning device 1 with a base unit 9 and an attachment 10. The attachment 10 is removably held on the base unit 9. The base unit 9 also has a stalk 11, for example which here has a telescoping design, so that a user of the wet-cleaning device 1 can adjust the length of the stalk 11 to his or her body size. Also arranged on the stalk 11 is a handle 12, which the user can use to guide the wet-cleaning device 1 during a conventional wiping operation, i.e., push it over a surface to be cleaned. During the wiping operation, the user usually guides the wet-cleaning device 1 over the surface to be cleaned in opposing movements b. He or she here alternately pushes out and pulls back the wet-cleaning device 1.

The attachment 10 has a housing, which holds a cleaning roller 3 so that it can rotate around a roller axis 2. A filler neck 13 is arranged on the housing, through which liquid can be filled into a liquid tank (not shown). The liquid stored in the liquid tank serves to moisten the cleaning roller 3.

During the wiping operation, the rotatably mounted cleaning roller 3 rotates around the roller axis 2, so that the circumferential surface of the cleaning roller 3 continuously rolls off onto a surface to be cleaned. The cleaning roller 3 is usually wound with a cleaning lining 4 (not shown on FIG. 1), possibly with a sponge body that stores additional liquid interspersed. For example, the cleaning lining 4 is here a textile cleaning cloth, between whose fibers 6 liquid and/or dirt can be picked up.

During the wiping operation, dirt continuously accumulates on the cleaning roller 3, i.e., on the cleaning lining 4. For this reason, it may become necessary after a certain operating period to regenerate the cleaning roller 3, wherein dirt and liquid loaded with dirt are removed from the cleaning roller 3 during a regeneration operation.

Figure 2:
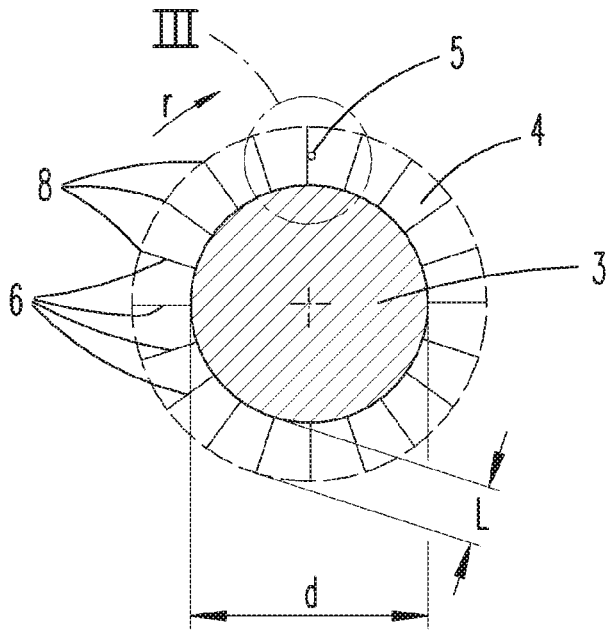
FIG. 2 is a cross section through a sketched cleaning roller of the wet-cleaning device.
Figure 3:
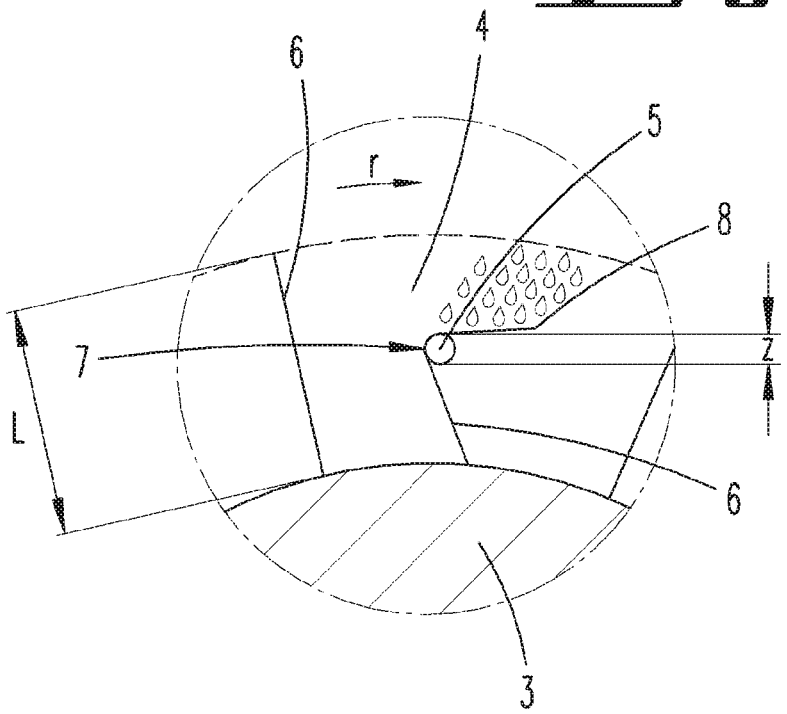
FIG. 3 is a magnified partial area of a cleaning lining of the cleaning roller.

FIG. 2 shows a sketch of a cross section of the cleaning roller 3 with a cleaning lining 4. The cleaning lining 4 is provided with a plurality of fibers 6, but only individual fibers 6 thereof are shown here for improved clarity. The free ends 8 of the fibers 6 form a continuous shell surface of the cleaning lining 4. The fibers 6 sketched on FIG. 3 are all mechanically unloaded at the point in time shown, meaning straight in a radial direction relative to the roller axis 2 and outwardly stretched. In this mechanically unloaded state, the fibers 6 each here have a length L of 8 mm, for example. The cleaning roller has a diameter of roughly 33 mm. However, the indicated dimensions are only exemplary. Other lengths, diameters and proportions are of course also possible.

A decelerating element 5 engages between the fibers 6 of the cleaning lining 4, and consists of a wire aligned parallel to the roller axis 2. This decelerating element 5 is shown as a point in the cross sectional view. The decelerating element 5 is arranged roughly at half the height of the fiber length L of the fibers 6. The height z of the decelerating element 5 itself is here equal to the diameter of the wire, and measures roughly 1 mm. The impact edge 7 opposing the fibers 6 during rotation is convexly shaped by the surface curvature of the wire. FIG. 2 exemplarily shows one fiber 6 from the plurality of fibers 6, which in the illustration is arranged on the left next to the decelerating element 5 relative to the rotational direction r of the cleaning roller 3 (clockwise rotation). In this state, the fiber 6 is still mechanically unloaded and stretched, since the latter is not yet in contact with the decelerating element 5.

Proceeding from FIG. 2, FIG. 3 shows a later point in time during the rotation of the cleaning roller 3, during which the fiber 6 impacts the impact edge 7 of the decelerating element 5, and its free end 8 is folded over the impact edge 7, specifically in the rotational direction 4 of the cleaning roller 3. The impact of the fiber 6 on the impact edge 7 folds the free end 8 of the fiber 6 around the decelerating element 5 in a whip-like manner, causing liquid and/or dirt adhering to the fiber 6 to be spun off. For example, the acceleration produced by the whip effect is here seven times higher than the acceleration of the fiber 6 that arises without the decelerating element 5 solely due to the centrifugal force that acts on the fiber 6 during the rotation of the cleaning roller 3. As further evident from the magnified view on FIG. 3, while the cleaning roller 3 continues to rotate, the fiber 6 is pulled clockwise through between the decelerating element 5 and surface of the cleaning roller 3, against which the cleaning lining 4 abuts, specifically in the area of the roots of the fibers 6, wherein the free end 8 of the fiber 6 is pulled off of the decelerating element 5, and passed under the decelerating element 5 stretched to more or less of an extent as a function of its inherent rigidity.

Figure 4:
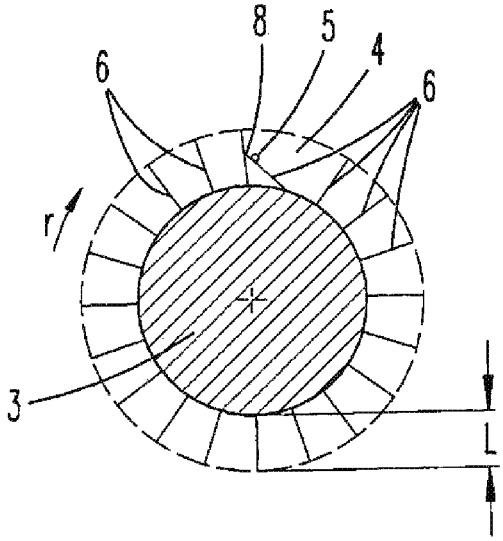
FIG. 4 is a cross section of the cleaning roller during continued rotation of the cleaning roller by comparison to FIG. 2 and FIG. 3.

FIG. 4 shows a later point in time than on FIG. 3 as the cleaning roller 3 continues to rotate. The fiber 6 is here nearly stretched, wherein the outermost end area of the free end 8 of the fiber 6 is situated roughly at the location of the decelerating element 5. As soon as the free end 8 has passed the decelerating element 5, its inherent rigidity causes the fiber 6 to again stand upright. If necessary, any residual liquid or residual dirt still adhering to the fiber 6 can here be spun off by standing up the fiber 6.

Figure 5:
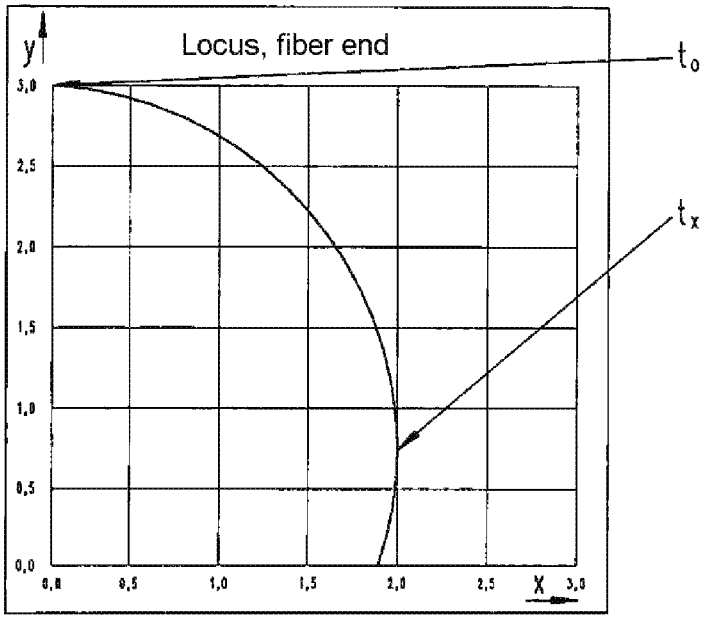
FIG. 5 is a locus of a free end area of a fiber of the cleaning lining.

Finally, FIG. 5 shows a locus of the fiber end, i.e., the outermost end area of the free end 8 of the fiber 6. The coordinate origin (0,0\0,0) here denotes the location of the root of the fiber 6, which is the location where the fiber 6 stands on the cleaning roller 3 inside of the cleaning lining 4. The lattice spacings of the diagrams shown (0,0 to 3,0) on the x-axis and y-axis are here randomly selected. For example, the latter are here selected for a fiber 6 having a fiber length L of 3.0 mm. At the point in time $t_0$ shown, the fiber 6 is still not in contact with the decelerating element 5. The fiber 6 is thus in a completely stretched state, and the free end 8 (i.e., the outermost end area of the fiber 6) is at a location with the relative coordinates x\y=0\3. At a later point in time (after $t_0$), the fiber 6 hits the decelerating element 5 as depicted on FIG. 3, and is folded over the impact edge 7. As a result, the free end 8 of the fiber 6 swings to the right over the impact edge 7 like a whip, but the distance between the free end 8 and root of the fiber 6 (coordinate origin 0,0) is simultaneously reduced. This is described on FIG. 5 by the curved progression of the locus. At point in time $t_x$, a change in sign arises relative to the x-coordinate of the current location of the free end 8 of the fiber 6, which corresponds to a point in time during the rotation of the cleaning roller 3 at which the delay of the fiber 6 by the decelerating element 5 has concluded. In this moment, the free end 8 of the fiber 6 is pulled around the decelerating element 5 opposite the rotational direction r of the cleaning roller 3, since the fiber 6 is guided through between the decelerating element 5 and cleaning roller 3, as shown on FIG. 4.

REFERENCE LIST

1 Wet-cleaning device
2 Roller axis
3 Cleaning roller
4 Cleaning lining
5 Decelerating element
6 Fiber
7 Impact edge
8 Free end
9 Base unit
10 Attachment
11 Stalk
12 Handle
13 Filler neck
B Direction of movement
d Roller diameter
L Fiber length
r Rotational direction
$t_0$ Point in time
$t_x$ Point in time
x Location coordinate
y Location coordinate
z Height

The invention claimed is:

1. A wet-cleaning device (1), having a cleaning roller (3) that can rotate around a roller axis (2), and has a cleaning lining (4) with fibers (6) having free ends, wherein the wet-cleaning device (1) has a decelerating element (5) to support the removal of liquid and/or dirt from the cleaning roller (3) during a regeneration operation, wherein the decelerating element (5) has an impact edge (7) relative to the roller axis (2), and during the regeneration operation is arranged so as to radially cover the fibers (6) of the cleaning lining (4) to such an extent that the free ends (8) of the mechanically unloaded fibers (6) outwardly protrude over the impact edge (7) in a radial direction, wherein the decelerating element (5) has an expansion that yields a distance between the decelerating element (5) and the roots of the fibers (6) and a distance between the free ends (8) of the fibers (6) extending in a radial direction and the decelerating element (5), so that the free ends (8) of the fibers (6) have leeway to bend over the impact edge (7) given an impact on the impact edge of the decelerating element and to be pulled off of the impact edge (7) in the direction opposite the bending as the cleaning roller (3) continues to rotate and be guided through between the cleaning roller (3) and decelerating element (5).

2. The wet-cleaning device (1) according to claim 1, wherein the decelerating element (5) is mounted on the wet-cleaning device (1) so as to be displaceable relative to the cleaning roller (3).

3. The wet-cleaning device (1) according to claim 1, wherein the decelerating element (5) is immovably arranged on the wet-cleaning device (1) during the regeneration operation.

4. The wet-cleaning device (1) according to claim 1, wherein the decelerating element (5) is essentially rod-shaped in design, and is a wire.

5. The wet-cleaning device (1) according to claim 1, wherein the decelerating element (5) has a height (z) of 0.3 to 5 mm, preferably a height (z) of 0.5 mm to 2 mm, in relation to a radial direction relative to the roller axis (2), and/or is arranged parallel to the roller axis (2) along the entire length of the cleaning lining (4).

6. The wet-cleaning device (1) according to claim 1, wherein the impact edge (7) of the decelerating element (5) is arranged roughly in the area of one fourth to one half the fiber length (L) of the fibers (6) relative to the mechanically unloaded fibers (6) facing in the radial direction.

7. The wet-cleaning device (1) according to claim 1, wherein the cleaning lining (4) is a textile lining.

8. The wet-cleaning device (1) according to claim 1, wherein the cleaning roller (3) has a roller diameter of 40 mm to 50 mm.

9. A method for operating a wet-cleaning device (1) wherein liquid and/or dirt are removed from a cleaning roller (3) of the wet-cleaning device (1) rotating around a roller axis (2) during a regeneration operation, wherein a decelerating element (5) for the regeneration operation is arranged so as to radially cover fibers (6) of a cleaning lining (4) of the cleaning roller (3) to a point where an impact edge (7) of the decelerating element (5) protrudes so far between the fibers (6) that the free ends (8) of the fibers (6) are folded over the impact edge (7) during the rotation of the cleaning roller (3), wherein the decelerating element (5) has an expansion that yields a distance between the decelerating element (5) and the roots of the fibers (6) and a distance between the free ends (8) of the fibers (6) extending in a radial direction and the decelerating element (5), so that the free ends (8) of the fibers (6) have leeway to bend over the impact edge (7) given an impact on the impact edge (7) of the decelerating element (5), and to be pulled off of the impact edge (7) in the direction opposite the bending as the cleaning roller (3) continues to rotate, and be guided through between the cleaning roller (2) and decelerating element (5).

10. The method according to claim 9, wherein the cleaning roller (3) is rotated during the regeneration operation at a speed of 1500 RPM to 6000 RPM.

11. The method according to claim 10, wherein the cleaning roller (3) is rotated during the regeneration operation at a speed of 4000 RM to 5000 RM.

12. The wet-cleaning device according to claim 5, wherein the decelerating element (5) has a height of 0.5 mm to 2 mm.

13. The wet-cleaning device according to claim 1, wherein the cleaning element (4) is a microfiber textile lining.

14. The wet-cleaning device according to claim 8, wherein the cleaning roller (3) has a roller diameter of 45 mm.

* * * * *